US005120024A

United States Patent [19]

Winkler

[11] Patent Number: 5,120,024

[45] Date of Patent: Jun. 9, 1992

[54] PAYOUT TENSION CONTROL SYSTEM FOR REEL MOUNTED CABLE

[75] Inventor: Gerhard B. Winkler, Highland, Md.

[73] Assignee: The United States of America as represented by the Secretary of the Navy, Washington, D.C.

[21] Appl. No.: 529,294

[22] Filed: May 29, 1990

[51] Int. Cl.[5] ..... B66D 1/00

[52] U.S. Cl. ..... 254/391; 254/335; 242/128

[58] Field of Search ..... 242/128, 82; 254/264, 254/391, 335, 334

[56] References Cited

U.S. PATENT DOCUMENTS

| | | | |
|---|---|---|---|
| 1,955,785 | 4/1934 | Arkema et al. | 242/128 |
| 2,487,889 | 11/1949 | Moore | 242/128 |
| 3,073,545 | 1/1963 | Frate et al. | 242/128 |
| 3,372,665 | 3/1968 | Mesler | 242/128 |
| 3,655,108 | 4/1972 | Bonnabaud et al. | 242/128 |
| 3,863,861 | 2/1975 | Bellasio | 242/128 |
| 4,135,679 | 1/1979 | Murphy et al. | 242/128 |
| 4,227,678 | 10/1980 | Laky | 254/391 |
| 4,253,624 | 3/1981 | Colbert | 242/128 |
| 4,320,619 | 3/1982 | Allard | 242/128 X |
| 4,322,047 | 3/1982 | Bonnabaud | 242/128 |
| 4,465,161 | 8/1984 | Ohta et al. | 254/391 X |
| 4,681,277 | 7/1987 | Kosch | 242/128 X |
| 4,848,078 | 7/1989 | White et al. | 242/128 X |
| 4,895,348 | 1/1990 | Craig | 254/391 |

FOREIGN PATENT DOCUMENTS

| | | | |
|---|---|---|---|
| 296987 | 7/1929 | United Kingdom | 242/128 |
| 341314 | 1/1931 | United Kingdom | 242/128 |

*Primary Examiner*—Katherine Matecki

*Attorney, Agent, or Firm*—Kenneth E. Walden; Jacob Shuster

[57] ABSTRACT

A payout control arm is angularly displaceable about a brake shaft during payout of a cable from a storage reel in response to tensioning forces transmitted through the cable from a payout load, the cable being entrained about a pulley rotatably carried on the control arm in spaced relation to the brake shaft. Gearing drivingly connects the pulley to the brake shaft to stop payout and cause the cable to frictionally grip the pulley in response to brake engagement thereby preventing continued transmittal of tensioning forces to the reel.

9 Claims, 2 Drawing Sheets

PAYOUT TENSION CONTROL SYSTEM FOR REEL MOUNTED CABLE

BACKGROUND OF THE INVENTION

This invention relates generally to the withdrawal or payout of flexible cable under tensile loading from a storage reel, and more particularly to control over such payout.

Payout of cable from a storage reel in mine mooring systems associated with marine vessels, for example, is often plagued by cable damage problems caused by excessive tensile loading. In such installations, the mooring cable is tightly and precisely wound on the storage reel in order to avoid cable deformation and cutting through successive layers of cable turns on the reel under tensile loading when payout is stopped. Payout is controlled by an electrically activated brake connected through a brake shaft to a payout arm that is rotated to peel the cable off a stationary reel.

In such existing mine mooring systems, the cable tensioning forces applied by the payout load, such as a buoyant capsule, were directly transmitted to the cable on the reel creating the aforementioned cable damage problem. Further, such cable payout systems required a high braking power capacity and large diameter cable to meet the cable loading demands associated with a correspondingly high anchor depth capability.

It is therefore an important object of the present invention to regulate payout of an elongated flexible cable, wound upon a storage reel, under control of a brake with reduced braking capacity while avoiding the aforementioned cable tension damaging problem.

An additional object of the invention in accordance with the foregoing object is to enable use of smaller diameter cable made of metallic or synthetic material in payout control systems of the aforementioned types.

SUMMARY OF THE INVENTION

In accordance with the present invention, the brake associated with the storage reel, from which a cable is withdrawn under tensile loading, regulates such cable withdrawal through a control arm supported on the brake shaft for angular displacement relative thereto during cable payout in response to the tensile loading. The cable during payout withdrawal guidingly extends through tubing fixed to the control arm and wound about a friction pulley rotatable on the control arm in spaced relation to the brake shaft. Reduction gearing drivingly connects the pulley to the brake shaft so as to stop payout with reduced loading impac in response to brake engagement operative interrupt rotation of the pulley through the brake shaft to thereby stopping angular displacement of the control arm. When rotation of the pulley is stopped, continued tensile loading on the cable causes it to frictionally grip the pulley to thereby absorb the tensioning forces and prevent transmittal thereof to the portion of the cable on the reel.

BRIEF DESCRIPTION OF THE DRAWING FIGURES

Other objects, advantages and novel features of the invention will become apparent from the following detailed description of the invention when considered in conjunction with the accompanying drawing wherein.

DETAILED DESCRIPTION OF THE PREFERRED EMBODIMENT

Figure 1:
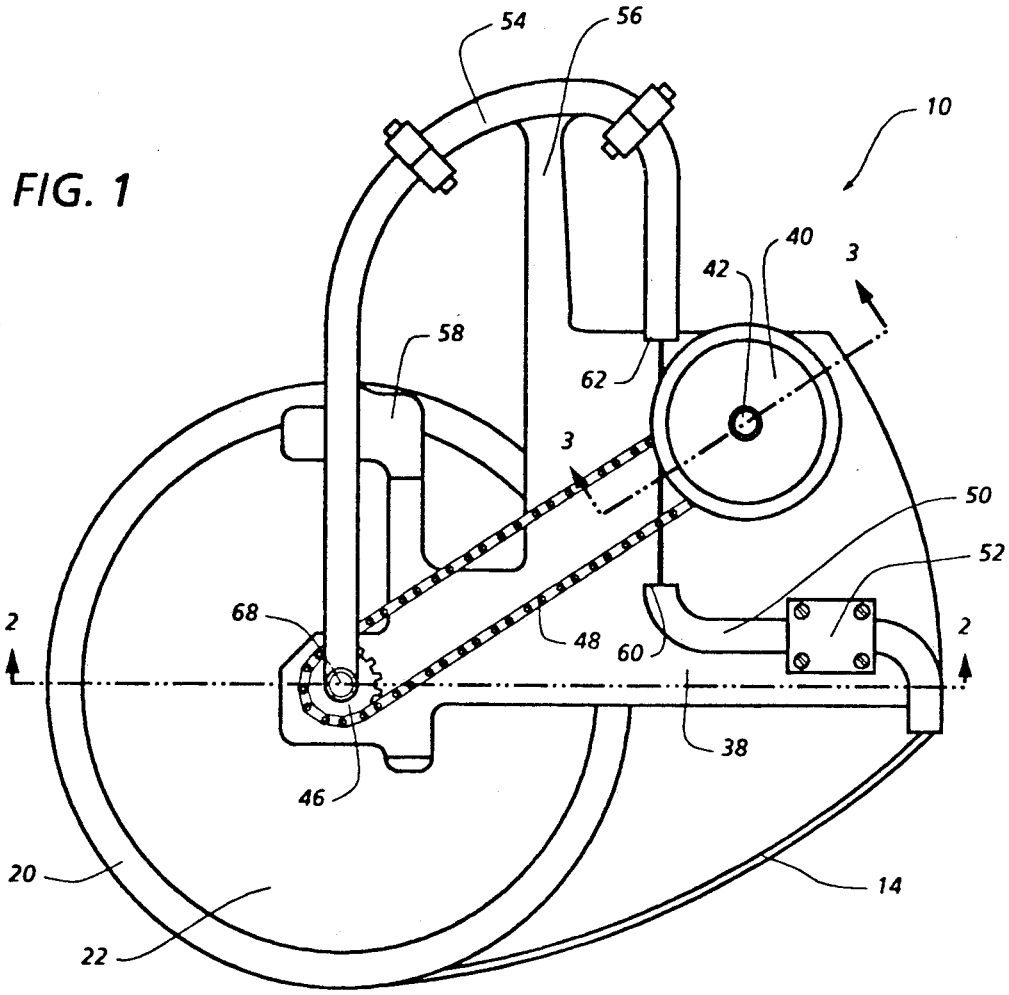
FIG. 1 is a top plan view of a cable storage reel and regulated payout control assembly in accordance with one embodiment of the present invention.
Figure 2:
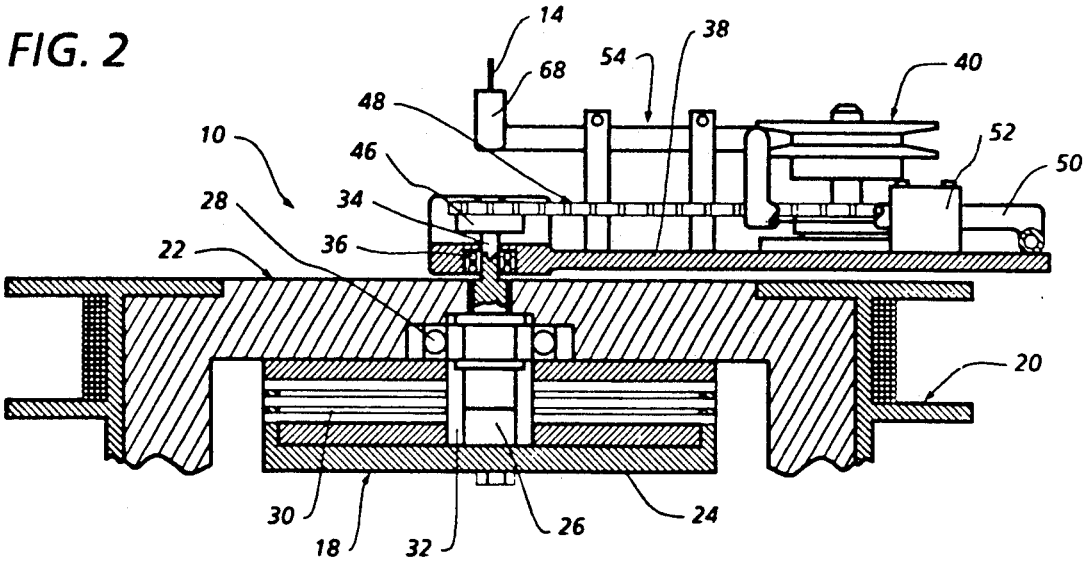
FIG. 2 is a section view taken substantially through a plane indicated by section line 2—2 in FIG. 1.
Figure 3:
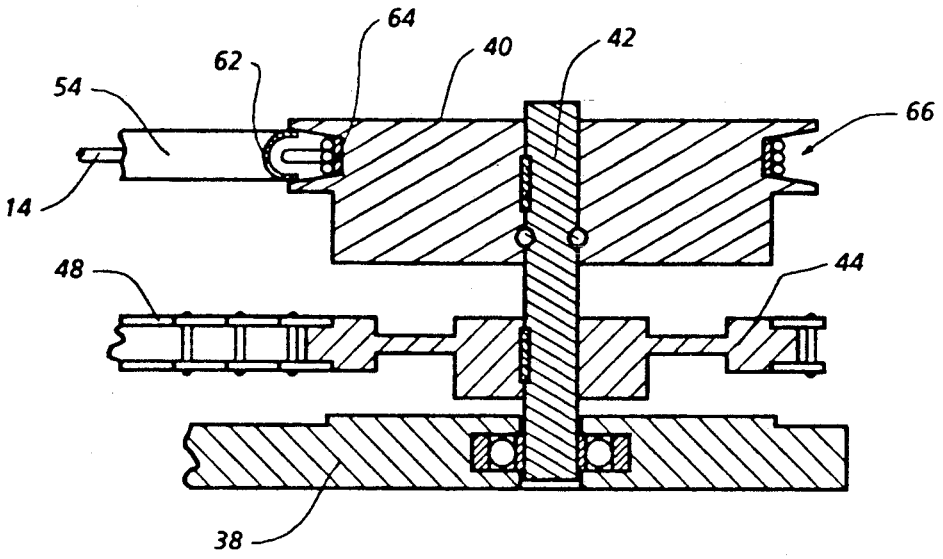
FIG. 3 is an enlarged partial section view taken substantially through a plane indicated by section line 3—3 in FIG. 1.
Figure 4:
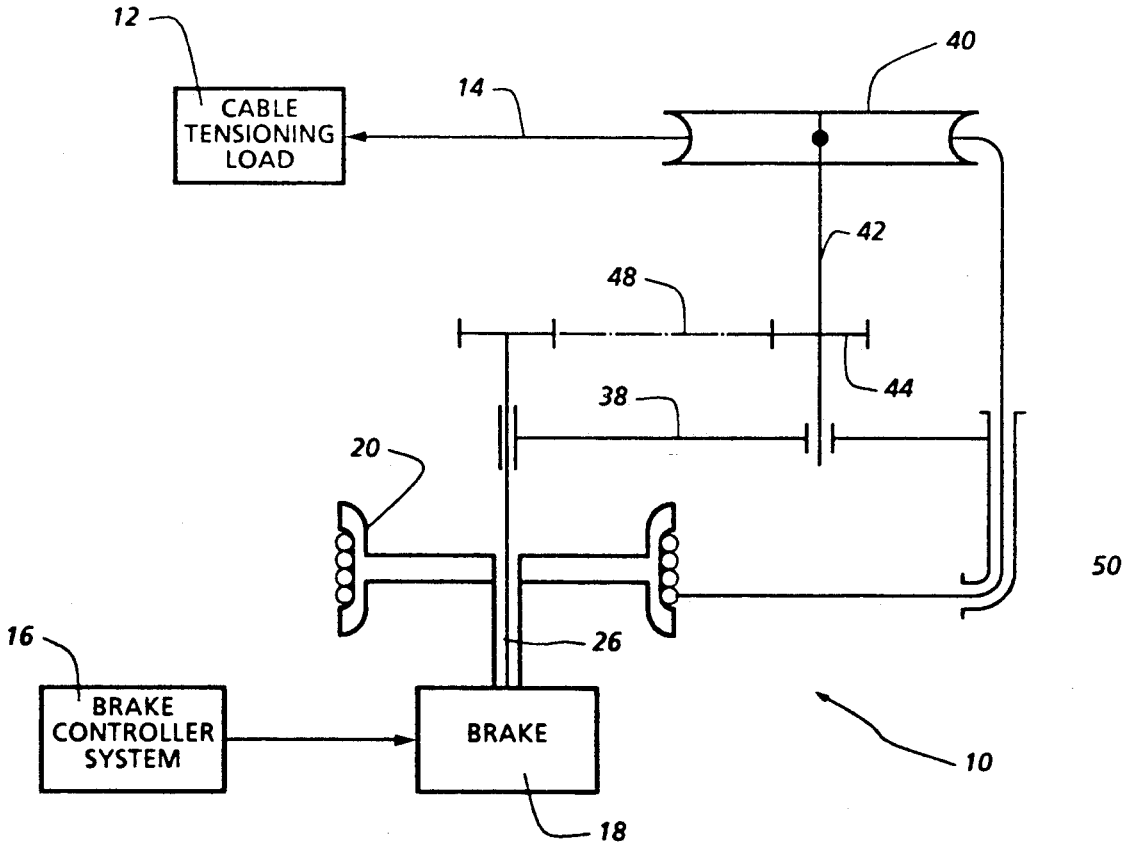
FIG. 4 is a schematic diagram of a system embodying the assembly depicted in FIGS. 1-3.

Referring now to the drawing in detail, FIGS. 1, 2 and 3 illustrate a cable storage assembly, generally referred to by reference numeral 10, constructed in accordance with one embodiment of the invention. The assembly 10 is schematically diagrammed in FIG. 4 in association with a cable tensioning load 12 through which tensioning forces are exerted on a flexible cable 14 that is stored by means of the assembly 10. Also associated with assembly 10 is a brake controller system 16 for activating a rotational control brake 18 of the assembly 10 in order to regulate payout of cable 14. The flexible cable 14 may be a mooring cable of any size or construction made of synthetic or metallic material wound in any conventional manner in layered turns on the reel component 20 of the assembly. The brake 18 may be electrically pulsed on and off by a controller system 16 in a generally well known manner in order to regulate payout of cable 14. An exemplary environment for such cable payout operation involves connection of cable 14 to a buoyant capsule type of load 12 which is to be held at a preset depth within a body of water while an associated anchor is sinking toward the ocean floor.

With reference to FIGS. 1, 2 and 3, the assembly 10 includes a housing 22 protectively enclosing the brake 18 and mounting the storage reel 20 upon which the cable 14 is wound and from which it is withdrawn under control of brake 18. The brake 18 includes a fixed spider 24 surrounding a rotatable brake shaft 26 extending from the housing 22 within which it is journaled by bearing 28. Interleaved brake discs 30 alternately fixed to the spider 24 and to the brake shaft 26 through sleeve 32 are controllably compressed to selectively retard and release rotation of the brake shaft 26 under control of system 16 externally of the assembly 10 as aforementioned in connection with FIG. 4.

The end portion 34 of the brake shaft 26 extending externally of housing 22 mounts a bearing 36 on which one end portion of a control arm 38 is journaled about a fixed axis of the shaft 26 and reel 20 as more clearly seen in FIG. 2. The control arm 38 rotatably mounts a tension absorbing pulley wheel 40 in radially spaced relation to the fixed rotational axis of brake shaft 26. Toward that end, the control arm 38 journals a pulley shaft 42 to which the pulley wheel 40 is splined as shown in FIG. 3.

The pulley shaft 42 is drivingly connected to the brake shaft 26 at a reduction drive ratio by means of sprocket gears 44 and 46 with which an endless sprocket drive chain 48 is enmeshed. Such drive connection between shafts 42 and 26 is thus carried on the control arm to not only regulate payout of cable 14 from the reel 20, by intermittent release of the brake 18 permitting free angular displacement of the control arm 38 about the rotational axis of the brake shaft, but also to enable absorption of tensioning forces otherwise transmitted through the cable from its load 12 to the storage reel 20 when the brake is applied. Such tensioning forces are thereby prevented from being transmitted to the layered portions of the cable retained on the reel 20 during periods between cable payout.

As more clearly seen in FIG. 1, a portion of the cable 14 extends, through tubing fixedly mounted on the control arm 38, between the reel 20 and the load to which the cable is connected. Such tubing includes a cable tensioning guide section 50 secured to the control arm by bracket 52 and a payout guide section 54 secured to the control arm by its extensions 56 and 58. The cable 14 is exposed between axially spaced ends 60 and 62 of the respective tube sections 50 and 54 in substantially tangential relation to the pulley wheel 40 as shown in FIG. 1.

As shown in FIG. 3, frictional engagement of the cable 14 with pulley wheel 40 is established by reception of several turns of the cable on a frictional lining 64 within the pulley groove 66. When rotation of pulley wheels 40 relative to control arm 38 is stopped during periods of brake engagement, braking forces transmitted to pulley wheel 40 through sprocket gearing 44-46-48 stop rotation of the control arm and payout of the cable by frictional gripping of the pulley wheel on the lining 64. Cable tensioning forces generated under such braking conditions are accordingly absorbed by such frictional gripping engagement of the pulley wheel. As a result, no tensioning forces are transmitted to the layered turns of the cable on the reel 20 during periods between payout operations.

When the brake 18 is released, the pull exerted on the cable 14 by its load 12 causes the control arm 38 to rotate about the axis of brake shaft 26. At the same time, such pull on the cable causes rotation of the pulley wheel 40 about its own rotational axis on control arm 38 to accommodate payout of the cable from the reel 20. Payout displacement of the cable to the load 12 is guided through the tubing on the control arm to its exit end portion 68 in axial alignment with the fixed rotational axis of brake shaft 26 as shown in the embodiment of FIGS. 1 and 2. In view of the reduction drive ratio of the gearing between the pulley wheel 40 and the brake shaft 26, the rotational speed of the brake shaft during such payout operation is reduced to correspondingly reduce the payout rate and cable impact in response to brake engagement.

Numerous other modifications and variations of the present invention are possible in light of the foregoing teachings. It is therefore to be understood that within the scope of the appended claims the invention may be practiced otherwise than as specifically described.

What is claimed is:

1. In combination with a storage reel on which a flexible cable is wound while connected to a loading device and control means for regulating payout of the cable under tensioning forces exerted by the loading device, the improvement comprising guiding means angularly displaceable relative to the reel through which the cable moves during said payout thereof and frictional means exerting a frictional force on the cable exclusively through the angularly displaceable guiding means for preventing movement of the cable when not being paid out, whereby the reel is then isolated from the tensioning forces.

2. The improvement as defined in claim 1 wherein said frictional means includes a pulley wheel about which the cable is entrained and means drivingly connecting the pulley wheel to the control means for rotation thereof at a predetermined drive ratio during said payout of the cable.

3. The improvement as defined in claim 2 wherein said control means includes a brake shaft, a control arm, means mounting the control arm on the brake shaft for allowing angular displacement thereof about said brake shaft and tubing fixed to the control arm, the cable extending through the tubing from the reel.

4. The improvement as defined in claim 1 wherein said control means includes a brake shaft, a control arm, means mounting the control arm on the brake shaft for allowing angular displacement thereof about said brake shaft and tubing fixed to the control arm, the cable extending through the tubing from the reel.

5. In combination with a storage reel on which a flexible cable is wound while connected to a loading device and rotational control means for regulating payout of the cable under tensioning forces exerted by the loading device, the improvement comprising guiding means displaceable relative to the reel through which the cable moves during said payout thereof, means exerting a force on the cable through the displaceable guiding means for preventing movement of the cable by the tensioning forces otherwise transmitted through the cable while not being paid out and impact reducing drive means operatively connecting the rotational control means to the force exerting means for controlling rotation thereof during said payout of the cable, whereby the reel is isolated from the tensioning forces when the cable is not being paid out.

6. The improvement as defined in claim 5 wherein said force exerting means includes a pulley about which the cable is entrained.

7. The improvement as defined in claim 6 wherein said displaceable guiding means includes a control arm on which the pulley is rotatably mounted.

8. In combination with a cable storing reel having a fixed rotational axis, a flexible cable wound on the reel, a loading device connected to the cable for applying tensioning forces thereto and rotational control means for regulating payout of the cable from the reel in response to said tensioning forces, the improvement comprising frictional means exerting a frictional force for preventing said tensioning forces exerted by the loading device from moving the cable and being transmitted to the reel and drive means operatively interconnecting the frictional means and the control means for limiting operation of the frictional means to said preventing the transmission of the tensioning forces to the reel when the cable is not being paid out.

9. The combination of claim 8 wherein said frictional means is rotatably mounted in spaced relation to the fixed axis in engagement with the cable and said drive means comprises impact reducing gear means for drivingly connecting said frictional means to the rotational control means.

* * * * *